US009574835B2

(12) United States Patent
Pflaumer et al.

(10) Patent No.: US 9,574,835 B2
(45) Date of Patent: Feb. 21, 2017

(54) FIREARM, IN PARTICULAR HANDGUN, AND METHOD OF PRODUCING A FIREARM

(71) Applicant: UMAREX GMBH & CO. KG, Arnsberg (DE)

(72) Inventors: Eyck Pflaumer, Arnsberg (DE); Martin Wonisch, Arnsberg (DE); Thomas Scheunert, Arnsberg (DE)

(73) Assignee: Umarex GmbH & Co. KG, Arnsberg (DE)

( * ) Notice: Subject to any disclaimer, the term of this patent is extended or adjusted under 35 U.S.C. 154(b) by 0 days.

(21) Appl. No.: 14/635,395

(22) Filed: Mar. 2, 2015

(65) Prior Publication Data

US 2015/0276334 A1 Oct. 1, 2015

(30) Foreign Application Priority Data

Feb. 28, 2014 (DE) ..... 10 2014 102 672

(51) Int. Cl.

| | |
|---|---|
| ***F41A 5/00*** | (2006.01) |
| ***F41A 3/62*** | (2006.01) |
| ***F41A 5/20*** | (2006.01) |
| ***F41C 3/00*** | (2006.01) |
| ***F41A 5/26*** | (2006.01) |

(52) U.S. Cl.
CPC .. *F41A 3/62* (2013.01); *F41A 5/20* (2013.01); *F41A 5/26* (2013.01); *F41C 3/00* (2013.01); *Y10T 29/49718* (2015.01)

(58) Field of Classification Search
CPC ..... F41A 3/24; F41A 3/26; F41A 3/88; F41A 5/02; F41A 5/18; F41A 5/32; F41A 5/36; F41C 3/00
See application file for complete search history.

(56) References Cited

U.S. PATENT DOCUMENTS 1,834,021 A * 12/1931 Destree ..... F41A 3/62 89/180
3,069,976 A * 12/1962 Stevens, Jr. ..... F41A 3/40 42/18

(Continued)

FOREIGN PATENT DOCUMENTS

| | | |
|---|---|---|
| DE | 6600918 U | 3/1969 |
| DE | 19910162 A1 | 8/2000 |
| FR | 2805341 A1 | 8/2001 |

*Primary Examiner* — Gabriel Klein
(74) *Attorney, Agent, or Firm* — Laurence A. Greenberg; Werner H. Stemer; Ralph E. Locher

(57) ABSTRACT

A firearm, in particular handgun, has a barrel mechanism with a barrel and a chamber, a closing mechanism with a slide and also a cylinder-piston mechanism for gas pressure-operated closure delay. The cylinder-piston mechanism has a hollow cylinder with a hollow cylinder wall. A channel is formed between the barrel mechanism and the cylinder-piston mechanism. The hollow cylinder wall is fitted with at least one reinforcing element. The firearm may be produced by the following process steps: introduction of a first portion of the bore into the basic body up to the recess; introduction of a second portion of the bore up to the hollow cylinder; drilling of the channel, wherein the drill is conducted through the bore; and introduction of the reinforcing element into the recess, wherein the bore is closed in a gas-tight manner.

16 Claims, 13 Drawing Sheets

(56) References Cited

U.S. PATENT DOCUMENTS

| | | | | | |
|---|---|---|---|---|---|
| 3,273,460 | A * | 9/1966 | Mason | F41A 5/24 | 42/25 |
| 3,886,844 | A * | 6/1975 | Kepplinger | F41A 3/86 | 89/191.02 |
| 3,990,346 | A * | 11/1976 | Irwin | F41A 3/62 | 89/180 |
| 4,580,484 | A * | 4/1986 | Moore | F41A 3/44 | 42/77 |
| 5,239,911 | A * | 8/1993 | Ostor | F41A 9/12 | 42/105 |
| 5,388,500 | A * | 2/1995 | Petrovich | F41A 3/62 | 89/129.01 |
| 5,734,120 | A * | 3/1998 | Besselink | F41A 3/86 | 89/163 |
| 8,596,185 | B1 * | 12/2013 | Soong | F41A 5/28 | 89/193 |
| 2002/0096042 | A1 * | 7/2002 | Adkins | F41A 3/62 | 89/194 |

* cited by examiner

FIREARM, IN PARTICULAR HANDGUN, AND METHOD OF PRODUCING A FIREARM

BACKGROUND OF THE INVENTION

Field of the Invention

The present invention relates to a firearm, in particular a handgun, having a barrel mechanism with a barrel and a chamber, a closing mechanism with a slide and also a cylinder-piston mechanism for gas pressure-operated closure delay. The cylinder-piston mechanism has a hollow cylinder with a hollow cylinder wall. A gas channel is arranged between the barrel mechanism and the cylinder-piston mechanism. The invention also relates to a method of producing a firearm.

A firearm of the aforementioned kind is sufficiently known in the art. Firearms include, in particular, semiautomatic handguns such as pistols. Alongside other components, the firearm comprises a closing mechanism with a slide that is set up to open or close the chamber and also a cylinder-piston mechanism for the gas pressure-operated closure delay, wherein the cylinder-piston mechanism comprises a hollow cylinder with a hollow cylinder wall, wherein a channel is arranged between the barrel mechanism and the cylinder-piston mechanism.

The principle used here to delay closure is also referred to as "gas pressure delay" or "gas pressure-operated closure delay".

It is disadvantageous, however, that the hollow cylinder, in particular the region of the hollow cylinder lying opposite the channel, is exposed to hot explosive gases and the accompanying smoke from the fired cartridge. In time, disadvantageous material changes can result in this region, even to the point of the hollow cylinder wall burning through.

BRIEF SUMMARY OF THE INVENTION

This is where the present invention comes into play and addresses the problem of providing an improved firearm, in particular a firearm in which there is a reduced risk of the hollow cylinder wall burning through.

According to the invention, this problem is solved by a firearm as claimed. The fact that the hollow cylinder wall of the hollow cylinder is equipped with a reinforcing element means that an improved firearm can be provided, particularly a firearm in which the risk of the hollow cylinder wall burning through is diminished. The reinforcing element is particularly characterized in that it exhibits better material properties in respect of heat and smoke effect compared with the material of the hollow cylinder wall. In particular, the reinforcing element is a rectangular plate made of hard metal, for example.

Further advantageous embodiments of the invention emerge in particular from the dependent claims. The features of the dependent claims may, in principle, be combined with one another in a random fashion.

In an advantageous embodiment of the invention, it may be provided that the reinforcing element is housed in a recess in the hollow cylinder wall. A recess can be easily introduced during the production process and the reinforcing element, which is made from a different material to the hollow cylinder wall, can be introduced in a subsequent production step.

In a further advantageous embodiment of the invention, it may be provided that the reinforcing element is housed below the surface of the hollow cylinder wall, in particular 0.5-1 mm below the surface of the hollow cylinder wall. In principle, the reinforcing element may also be configured as part of the surface of the hollow cylinder wall. However, it has proved advantageous from a production point of view for the reinforcing element to be arranged beneath the surface in the hollow cylinder wall.

In a further advantageous embodiment of the invention, it may be provided that the reinforcing element is made of hard metal. Hard metals are characterized by a very high hardness, wear resistance and, in particular, by a high hot hardness and, accordingly, are advantageous for the purpose intended here.

In a further advantageous embodiment of the invention, it may be provided that the reinforcing element is configured as a rectangular plate. A corresponding plate can be procured inexpensively as a bought-in part and easily assembled.

In a further advantageous embodiment of the invention, it may be provided that the reinforcing element is disposed on the opposite side of the channel opening of the hollow cylinder. In this region, the attachment of the reinforcing element produces the greatest effect, as this will be the region that the hot explosive gas reaches first, before it disperses in the remaining hollow cylinder.

In a further advantageous embodiment of the invention, it may be provided that a bore is disposed in the hollow cylinder wall on the opposite side of the channel opening of the hollow cylinder, wherein the bore exhibits a first portion and a second portion, wherein the recess is disposed between the first portion and the second portion and is assigned to the second portion, wherein the reinforcing element is housed in the recess. An embodiment of the housing region for the reinforcing element of this kind brings with it production advantages. The bore can be used to drill the channel between the barrel mechanism and the hollow cylinder in the already connected unit made up of the basic body and the barrel mechanism, in that a drill is introduced through the bore which is able to drill the channel, in particular through the basic body or hollow cylinder wall and barrel mechanism. The bore can then be closed by the reinforcing element by introducing the reinforcing element into the recess.

In a further advantageous embodiment of the invention, it may be provided that the hollow cylinder comprises at least a first portion and a second portion in the longitudinal direction, wherein the first portion exhibits a smaller diameter than the second portion, wherein the piston is provided with at least one circumferential groove. In this way, the cylinder-piston mechanism can be set up for automatic cleaning of smoke and dirt from the hollow cylinder during the repeating of the firearm.

A further problem addressed by the present invention is that of proposing an advantageous method of producing a firearm as claimed.

According to the invention, this problem is solved by at least the following process steps:

- introduction of a first portion of the bore into the basic body up to the recess;
- introduction of a second portion of the bore up to the hollow cylinder;
- drilling of the channel between the hollow cylinder and the barrel mechanism, wherein the drill is conducted through the bore;
- introduction of the reinforcing element into the recess, wherein the bore is closed in a gas-tight manner.

By means of the method proposed here, the channel can be introduced into the firearm in an advantageous manner in production terms, particularly since the channel can be introduced into the unit made up of an already connected basic body and barrel mechanism.

BRIEF DESCRIPTION OF THE SEVERAL VIEWS OF THE DRAWING

Further features and advantages of the present invention will become clear from the following description of preferred exemplary embodiments with reference to the attached figures. In the figures.

Figure 1:
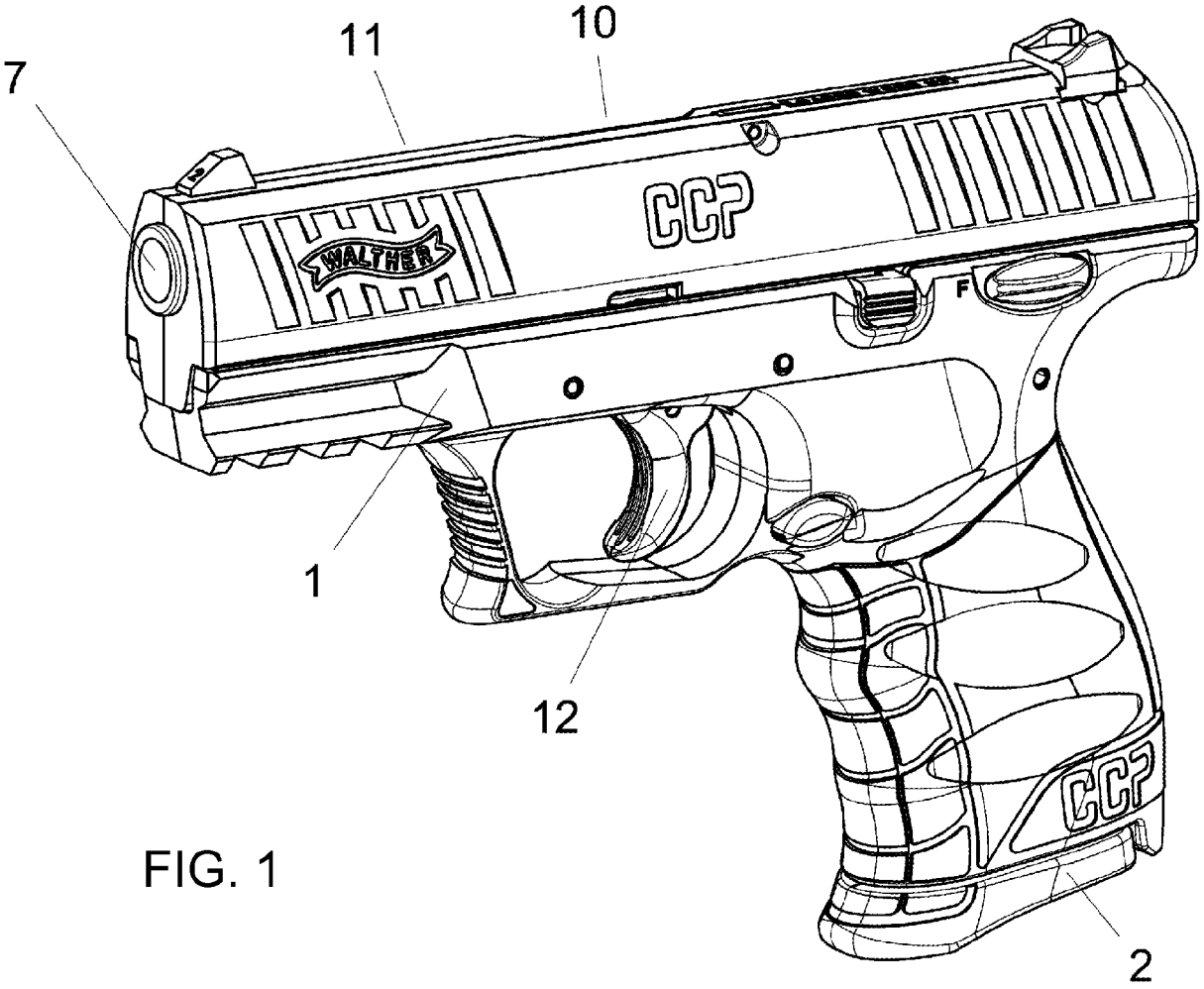
FIG. 1 shows a perspective view of a firearm according to the invention.

The following reference numbers are used in the figures:

1 Basic body
2 Magazine housing/magazine
3 Barrel
4 Chamber, cartridge chamber
5 Barrel/chamber longitudinal axis
6 Cartridge
7 Muzzle
8 Impact base plate
9 Extractor
10 Ejection opening
11 Slide
12 Trigger
13 —free
14 Roller
15 Trigger sear
16 Compression spring
17 Firing pin
18 Firing pin catch edge
19 Firing pin spring
20 Hollow cylinder
21 Piston
22 Channel
23 Reinforcing element/hard metal insert
31 Barrel wall
61 Cartridge case
62 Bullet
111 Slide spring
201 Hollow cylinder wall
202 Base plate
203 Opening
204 Longitudinal axis
205 Bore
206 Recess
207 First portion of the hollow cylinder
208 Second portion of the hollow cylinder
211 Groove
221 First channel opening
222 Second channel opening

DESCRIPTION OF THE INVENTION

The basic structure of a firearm, in particular a hand gun, preferably in the nature of a pistol, will be sufficiently familiar to the person skilled in the art. Essentially, a firearm of this kind comprises a basic body 1, a closing mechanism, a barrel mechanism, a trigger mechanism and a magazine housing 2 with a magazine.

The barrel mechanism essentially comprises a barrel 3 with a muzzle 7 and the chamber 4. The longitudinal axis of the barrel and of the chamber is labelled using the reference number 5. The chamber 4 is preferably set up to house the cartridge case 61 of a cartridge 6 and arranged on the opposite side of the muzzle 7.

The closing mechanism in particular comprises a slide 11 with an impact base plate 8. The slide 11, also referred to as the closure carriage or carriage, is essentially movably mounted on the basic body 1. The slide 11 may, in addition, comprise an extractor 9 and an ejection opening 10.

The trigger mechanism essentially comprises a trigger 12, a trigger rod (not shown or only shown concealed), a roller 14, a trigger sear 15, a compression spring 16, a firing pin 17 with a firing pin catch edge 18 and a firing pin spring 19. Alternative trigger mechanisms are conceivable in this case too, particularly in the form of a trigger mechanism with a hammer.

The theoretical structure and functional interplay of the aforementioned components of the firearm are sufficiently familiar to the person skilled in the art and only a cursory description will be given below by way of example.

A cartridge 6 is located in the chamber 4; the chamber 4 is closed by the slide 11, in particular the impact base plate 8 of the slide 11. The firing pin spring 19 is tensioned. The firing pin 17 or else the firing pin catch edge 18 is held by the trigger sear 15. By operating the trigger 12, the firing pin 17 is released, moves in the direction of the chamber 4 and strikes the percussion cap of the cartridge 6. The cartridge 6 substantially exhibits a cartridge case 61, a bullet 62 and a propellant. The propellant of the cartridge 6 ignites and produces a large amount of explosive gas. The resulting pressure drives the bullet 62 of the cartridge 6 through the barrel 3, while the slide 11, in particular the impact base plate 8, furthermore keeps the chamber 4 closed or else keeps the cartridge case in the chamber 4.

The delay of the slide 11 during firing takes place due to a gas pressure-operated closure delay which is dealt with in greater detail below.

After firing, the slide 11, in particular the impact base plate 8, moves away from the chamber 4 thereby opening the chamber 4, while the extractor 9 pulls the cartridge case 61 out of the chamber 4 and ejects it out of the ejection opening 10. On its way back, the slide 11 or else the impact base plate 8 pushes a new cartridge out of the magazine 2 into the chamber 4 and then closes the chamber 4 once again. In the same way, the firing pin 17 is pushed back again and the firing pin spring 19 is tensioned again. The trigger sear 15 holds the firing pin 17 on its firing pin catch edge 18. The weapon is once again ready to fire.

For the invention proposed here, the closure mechanism is of particular interest; this is, in particular, a closure mechanism that has a "gas pressure-operated closure delay". The closure mechanism comprises, in addition to the components already mentioned, a cylinder/piston mechanism, wherein a channel 22 is provided between the barrel mechanism and the cylinder-piston mechanism.

The cylinder-piston mechanism essentially comprises a hollow cylinder 20 and a piston 21 movably housed in the hollow cylinder.

The hollow cylinder 20 is preferably configured as an elongated hollow cylinder that is circular in cross section. The longitudinal axis of the hollow cylinder 20 is labelled using the reference number 204. The hollow cylinder exhibits a hollow cylinder wall 201, a base plate 202 and an opening 203 opposite the base plate. The longitudinal axis 204 of the hollow cylinder 20 is preferably oriented parallel to the longitudinal axis 5 of the barrel 3. The hollow cylinder wall 201 surrounds the hollow cylinder 20. The hollow cylinder 20 is preferably part of the basic body 1, in particular the hollow cylinder 20 is machined out of the basic body 1. The material that can possibly be used for the basic body 1 or the hollow cylinder wall 201 is in principle steel.

The barrel 3 has a barrel wall 31.

The channel 22 has a first channel opening 221 and a second channel opening 222. The first channel opening 221 is configured as the opening in the hollow cylinder wall 201 and the second channel opening 222 as the opening in the barrel wall 31, preferably right next to the chamber 4. To this extent, the channel 22 is preferably provided between the barrel 3 and the hollow cylinder 20.

The cylinder-piston mechanism is essentially used for the delay of the slide 11 by the gas pressure of the explosive gas of the fired cartridge. The following, schematically depicted, exemplary functional relationship results in the interplay with the channel 22.

As long as the bullet 62 is in the barrel 3 following the explosion of the propellant, part of the explosive gas from the detonated propellant passes via the second channel opening 222 into the channel 22 and from there through the first channel opening 221 into the hollow cylinder 20 of the cylinder-piston mechanism. Through the excess pressure of the explosive gas, the piston 21 is acted upon with a corresponding force. The piston 21 is pushed forwards in the direction of the muzzle 7. The piston 21 is connected to the slide 11, such that the pressure exerted on the piston 21 acts against the recoil of the fired cartridge 6. This principle is also referred to as "gas pressure delay" or "gas pressure-operated closure delay".

The cylinder-piston mechanism in this case can still be counteracted by a slide spring 111 which likewise counteracts the recoil of the fired cartridge exerted on the slide 11.

As a rule, shortly before the bullet 62 has left the barrel 3, the explosive gas may escape from the hollow cylinder 20 via the channel 22 and then via the barrel 3. The remainder of the explosive gas remaining in the barrel 3 exerts a pressure on the cartridge case still located in the chamber and on the slide 11 or the impact base plate 8. This residual pressure is strong enough to move the slide 11 against the force of the slide spring 111. The slide 11 slides backwards and thereby once again tensions the firing pin spring 19, the chamber 4 is opened and the extractor 9 pulls the cartridge case 61 out of the chamber 4, so that it can be ejected from the ejection opening 10. Once a rear end position has been reached, the slide spring 111 pushes the slide 11 forwards again. On the way forwards, the slide 11 carries along the next cartridge 6 from the magazine 2 with it and pushes it into the chamber 4. The firearm is ready to fire again.

As already indicated above, the hot explosive gases emerging straight from the cartridge case 61 which are mixed with smoke are introduced into the hollow cylinder 20 via the channel 22.

The first channel opening 221 is configured as an opening in the hollow cylinder wall 201 of the hollow cylinder. Accordingly, the channel opening 221 also lies opposite a portion of the hollow cylinder wall 201. The very hot explosive gases encounter one another on this portion of the hollow cylinder wall 201 when they are conducted through the channel 22. In this case, it is provided according to the invention that the hollow cylinder wall 201 is reinforced in this region, in particular that a reinforcing element 23, preferably a hard metal insert, is inserted there.

Hard metals can be used in principle as the material for the reinforcing element 23. Hard metals are essentially taken to mean sintered carbide hard metals. Hard metals are characterized by a very high hardness, wear resistance and, in particular, by a high hot hardness. A preferred hard metal mainly comprises 90-94% tungsten carbide (reinforcing phase) and 6-10% cobalt (matrix, binding agent, toughness component). The tungsten carbide grains are on average roughly 0.5-1 micrometer in size. The cobalt fills the gaps. A reinforcing element 23 made of a ceramic material is also conceivable in principle.

The reinforcing element 23 preferably exhibits a hardness of roughly 1300 HV 30 (Vickers hardness test), preferably 1300 HV 30. The compressive strength is around 4820 MPa (megapascal), in particular 4820 MPa.

In the preferred embodiment of the invention proposed here, the reinforcing element 23 is inserted in a recess 206 just beneath the surface of the hollow cylinder wall 201 in respect of the first channel opening 221. In a preferred exemplary embodiment, the reinforcing element 23 may be a plate, in particular a roughly rectangular plate with dimensions of approximately 8 * 10 * 2 mm.

The recess 206 preferably exhibits a slight undersize in respect of the reinforcing element 23 being inserted, such that said reinforcing element is lodged independently after it has been driven in, by means of a hammer for example. A force-fit of the reinforcing element 23 results in principle. The mounting of the reinforcing element 23 can be ensured in some other manner, for example by a conical form of the reinforcing element 23.

In an alternative embodiment not depicted here, it may also be provided that the reinforcing element 23 is part of the surface of the hollow cylinder.

In addition, measures can be envisaged that to some extent allow automatic cleaning of the hollow cylinder 20. For this purpose, the hollow cylinder 20 exhibits a first portion 207 and a second portion 208 in the longitudinal direction. In addition, the piston 20 exhibits at least one, preferably a number of, circumferential groove(s) 211.

The first portion 207 of the hollow cylinder 20 is preferably turned towards the muzzle 7 or the opening 203 of the hollow cylinder 20, while the second portion 208 is arranged on the side of the hollow cylinder 20 turned towards the magazine 2 or the base plate 202 of the hollow cylinder 20. The channel opening 222 of the hollow cylinder is preferably arranged in the first portion 207 of the hollow cylinder. The first portion 207 preferably exhibits a smaller diameter than the second portion 208.

The cleaning of the hollow cylinder 20 is particularly functionally configured as follows. In an initial state, the piston 21 is sectionally housed in the first portion 207. The grooves 211 are preferably still located outside the hollow cylinder 20. As already illustrated above, the piston 21 travels during repeating in the hollow cylinder 20, in particular from the first portion 207 into the second portion 208 and back again into the first portion 207. In this case, the piston 20 pushes the smoke out of the first portion 207 into the second portion 208. On the way back, in other words when the piston moves back out of the second portion 208 into the first portion, a large part of the smoke accumulates in the grooves of the piston 21. The smoke is therefore drawn out of the second portion 208 to some extent, transported through the first portion 207 and can then be ejected from the grooves 211 when the region of the grooves 211 of the piston 20 has left the first portion 207. In this way, the piston 20 performs an automatic cleaning of the hollow cylinder 20 with every shot.

Figure 2:
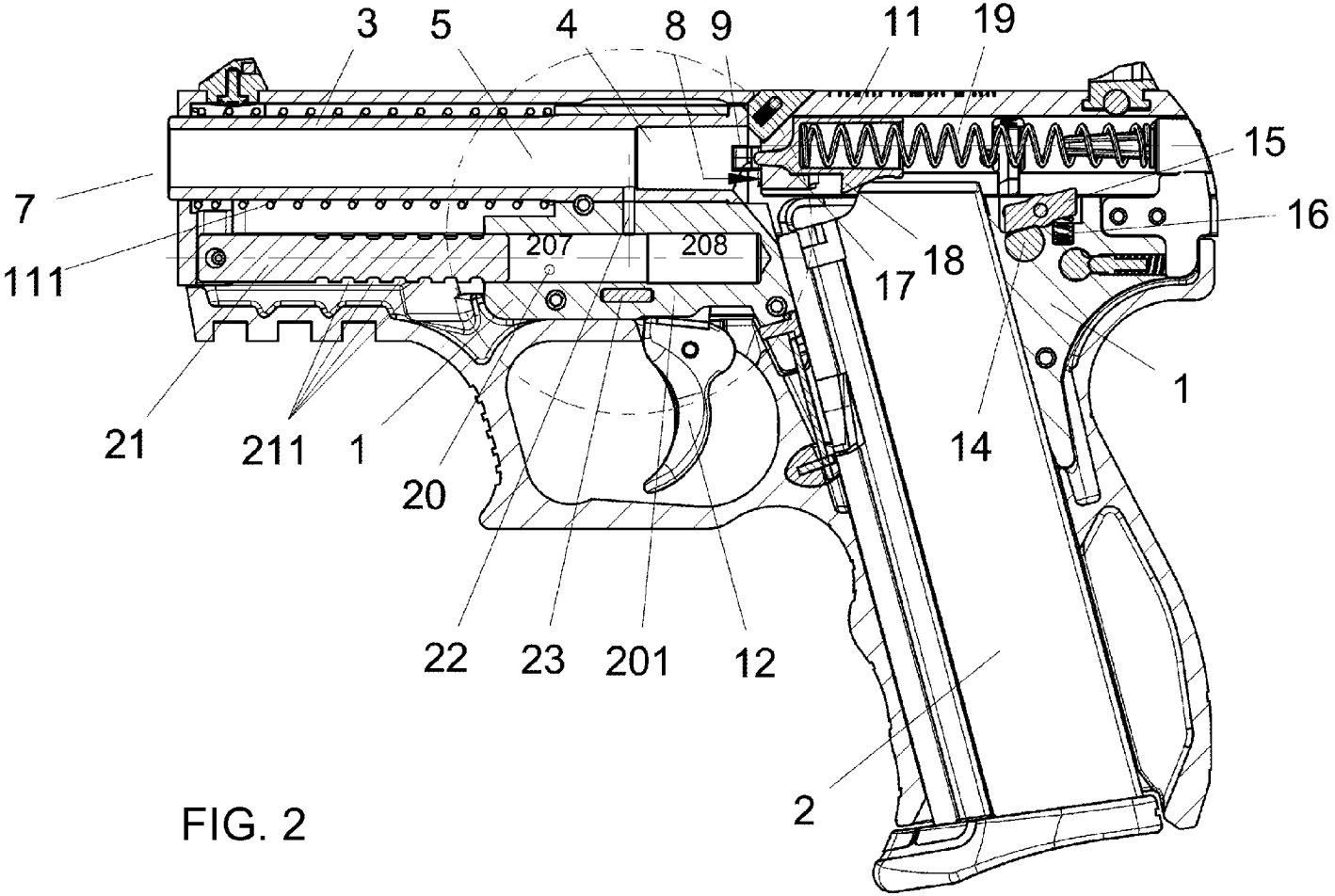
FIG. 2 shows a side, sectional view of the firearm according to the invention.
Figure 2A:
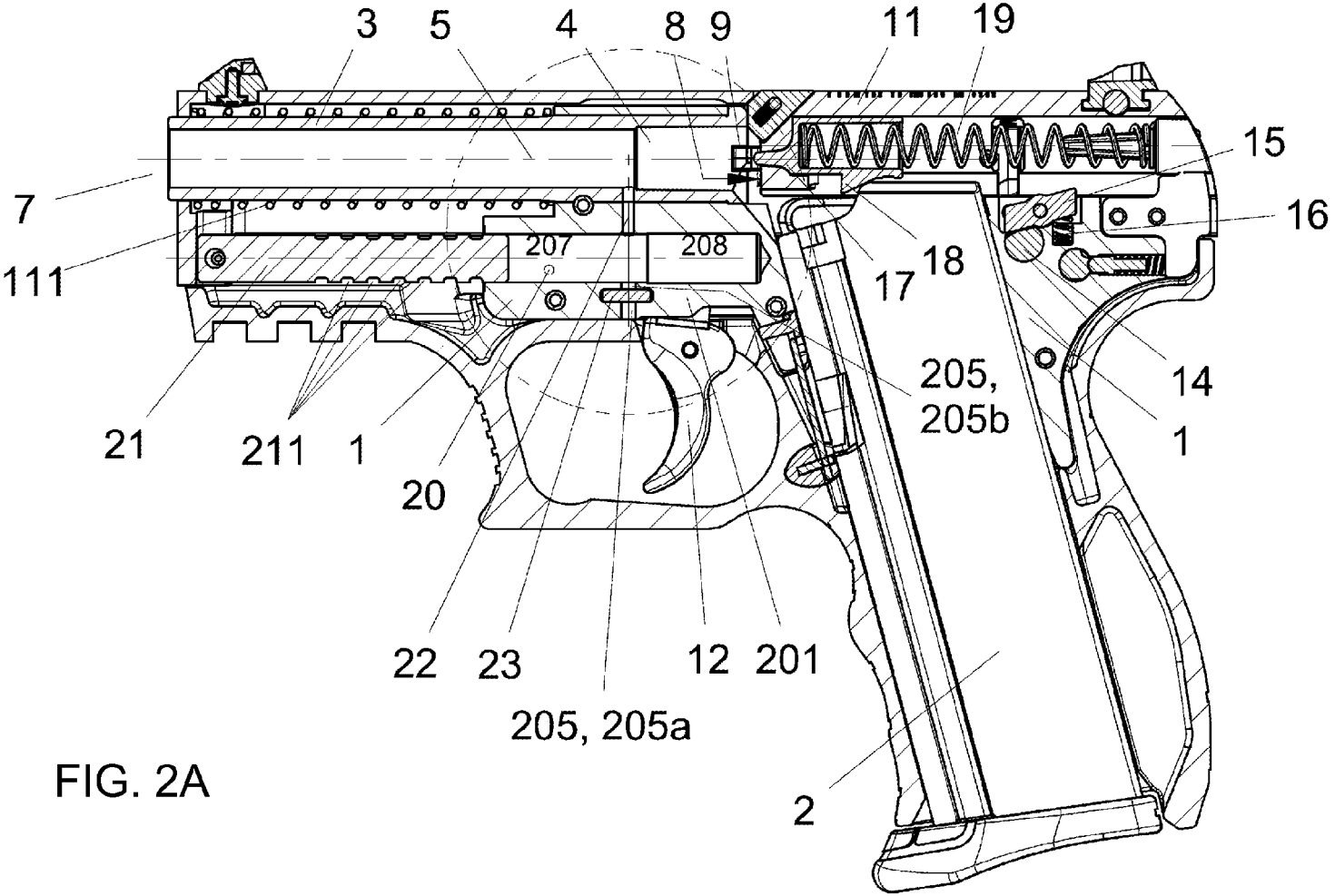
FIG. 2*a* shows a side, sectional view of an alternative embodiment of a firearm according to the invention.
Figure 3:
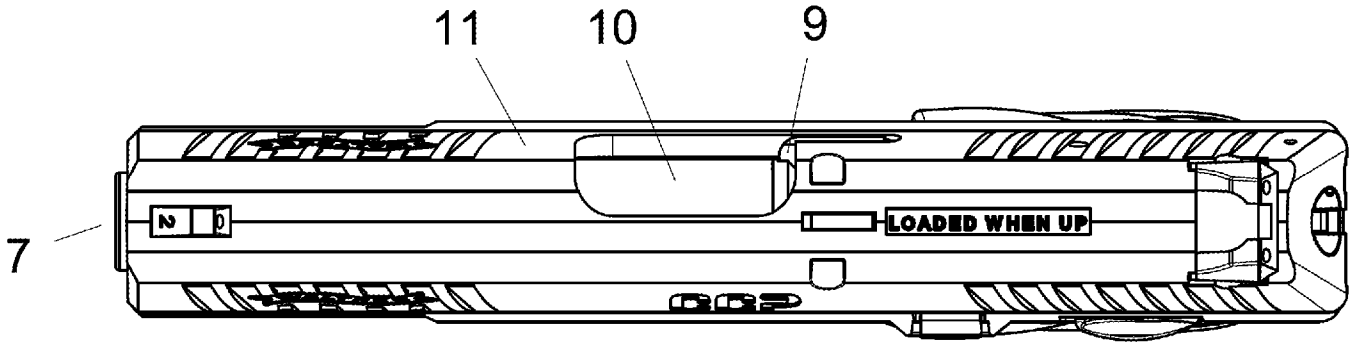
FIG. 3 shows a view from above of a firearm according to the invention.
Figure 4:
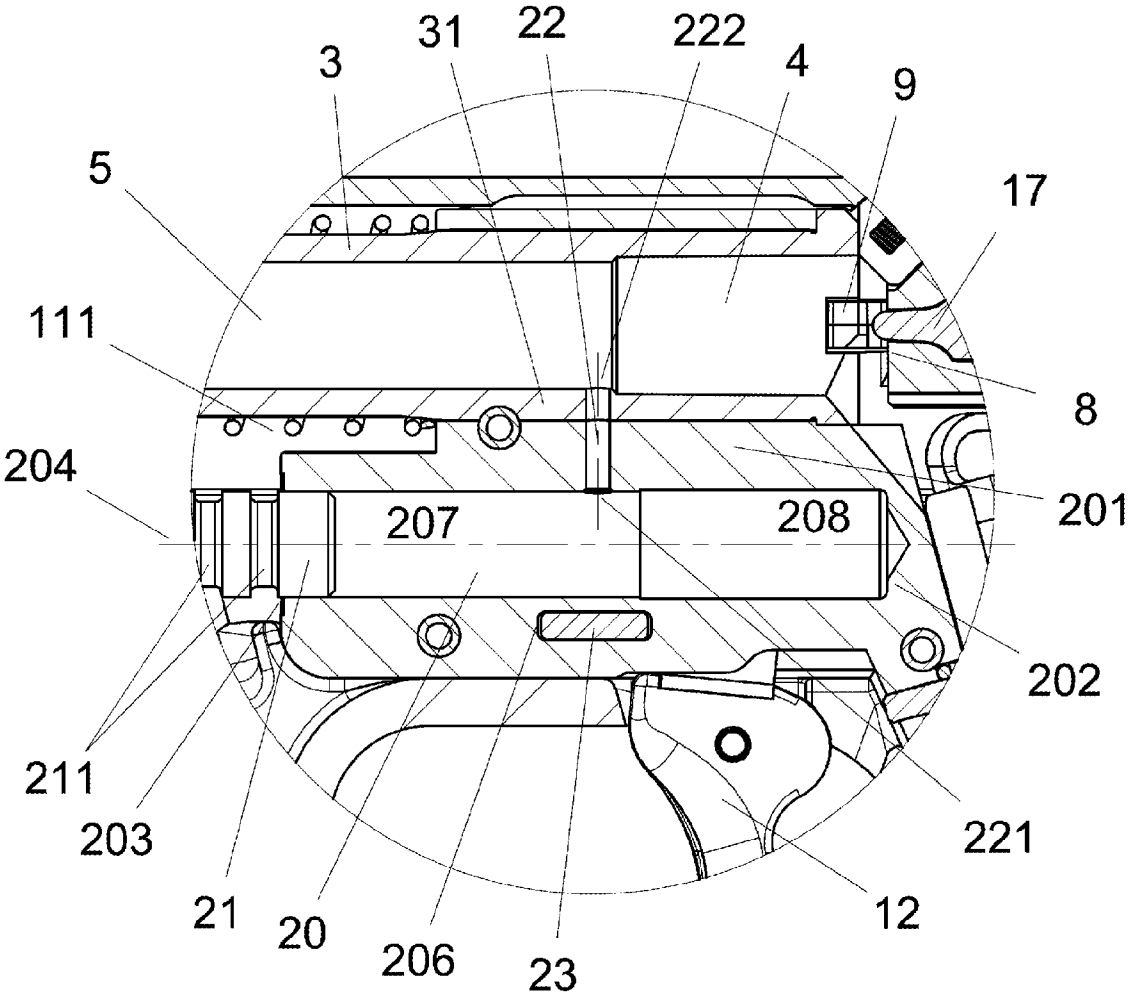
FIG. 4 shows an enlarged view of the region—chamber, channel, hollow cylinder—of a firearm according to the invention.
Figure 5:
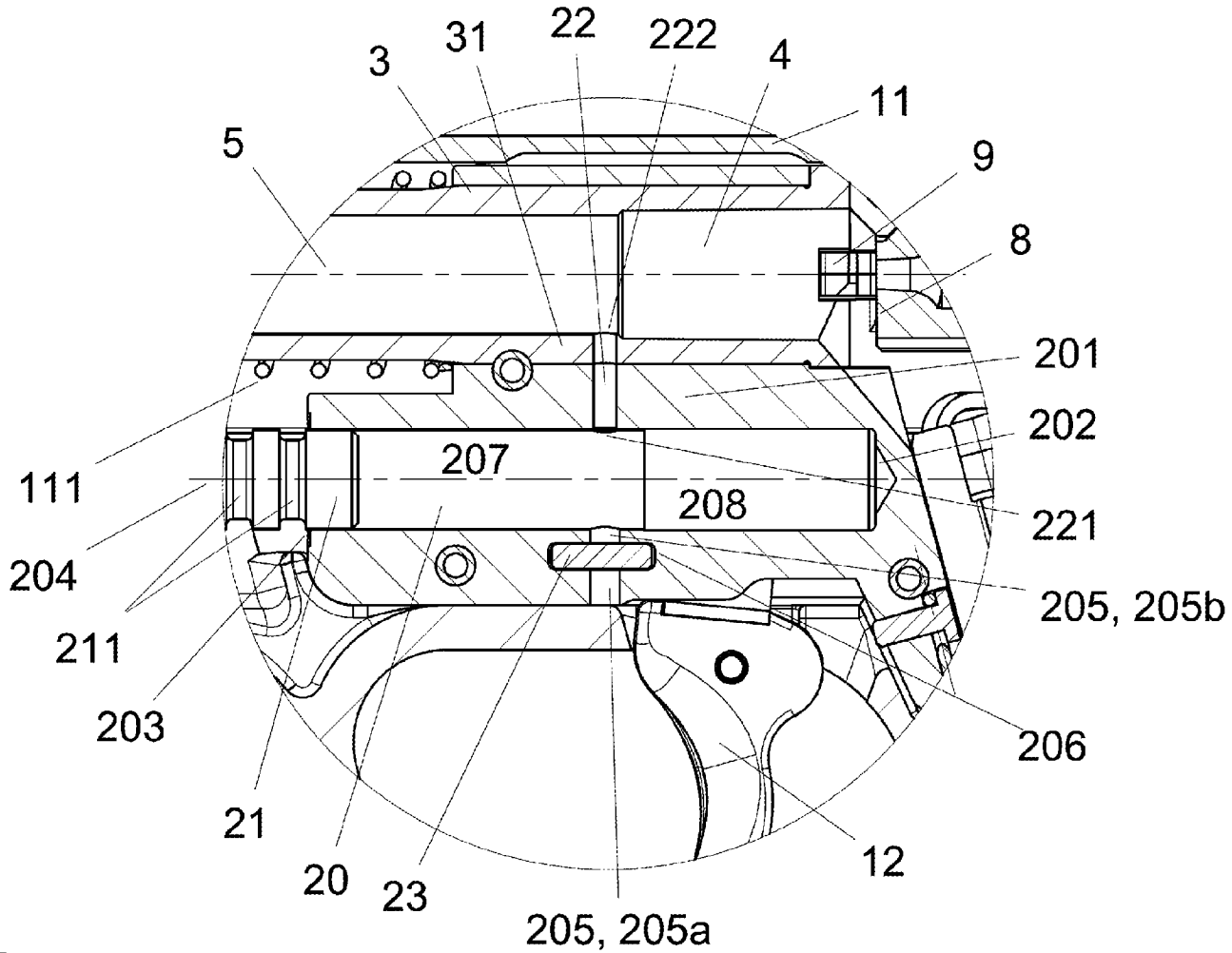
FIG. 5 shows an enlarged view of the region—chamber, channel, hollow cylinder—of a firearm according to the invention as an alternative embodiment with a bore.
Figure 6:
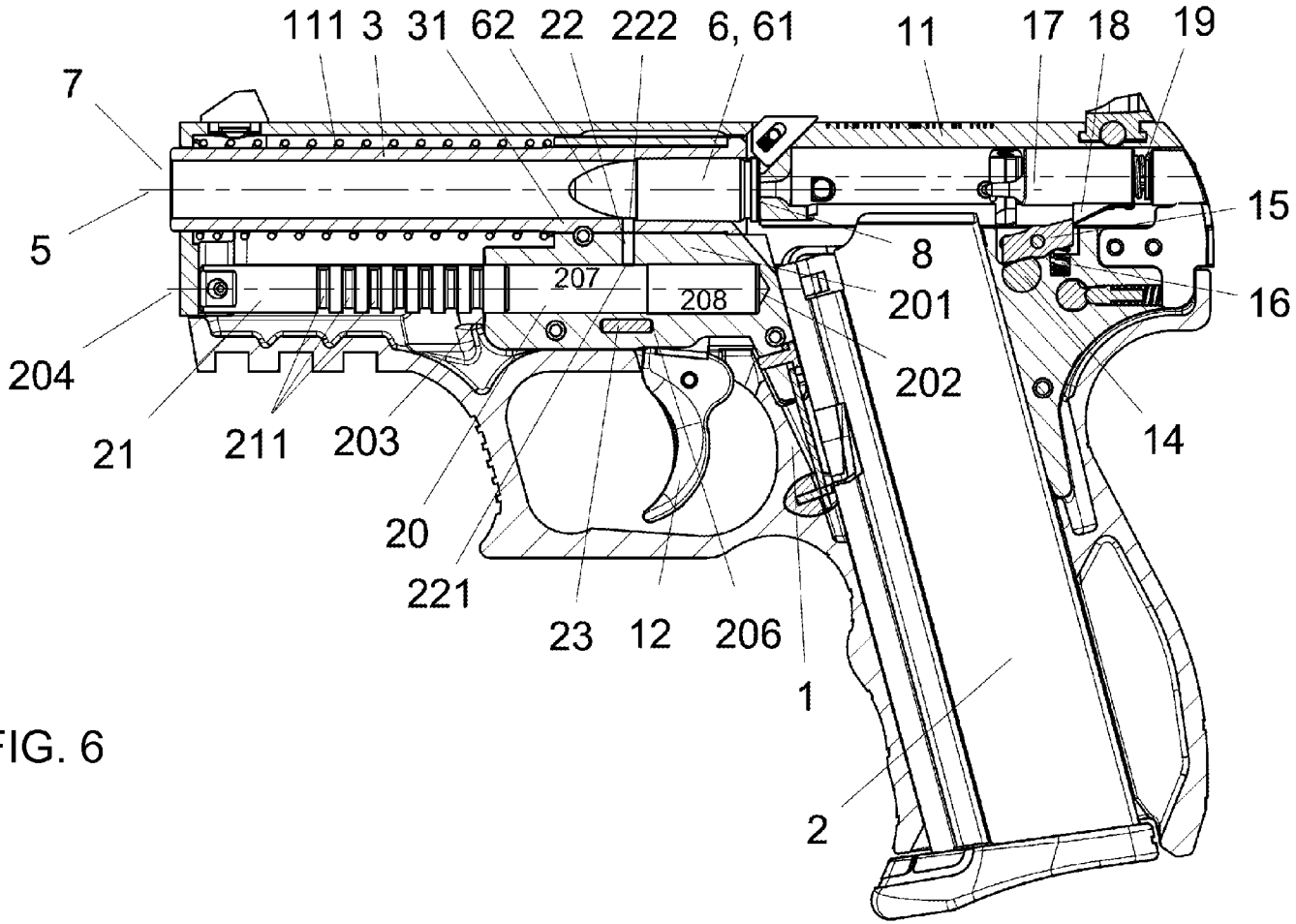
FIG. 6 shows a schematic flow diagram of a shot being fired—in this case: cartridge in the chamber.
Figure 7:
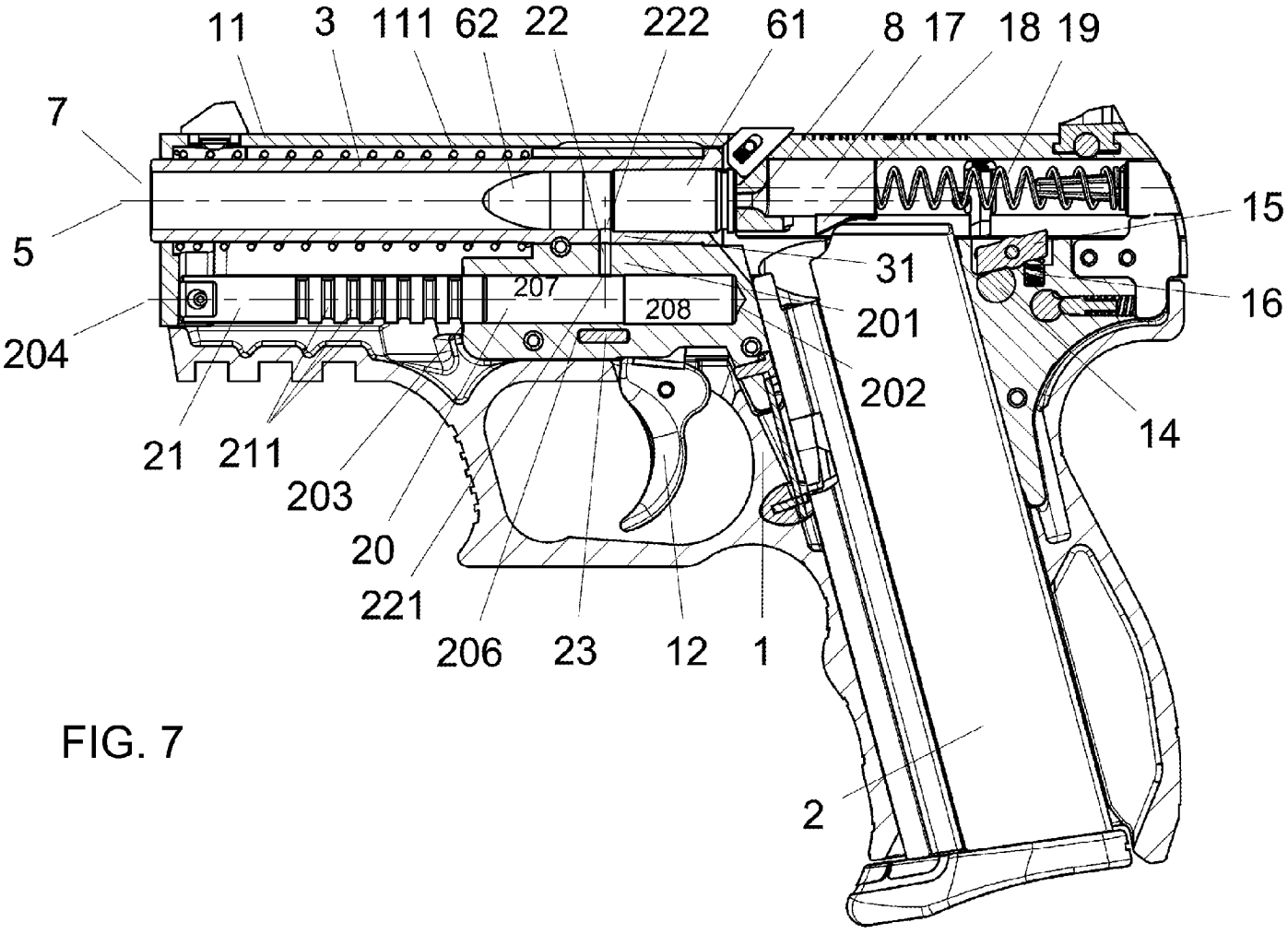
FIG. 7 shows a schematic flow diagram of a shot being fired—in this case: shortly following detonation of the propellant, bullet in flight, part of the explosive gas flows through the channel into the cylinder and pushes the piston in the muzzle direction, as a result of which the slide, in particular the impact base plate, is pressed in the direction of the chamber.
Figure 8:
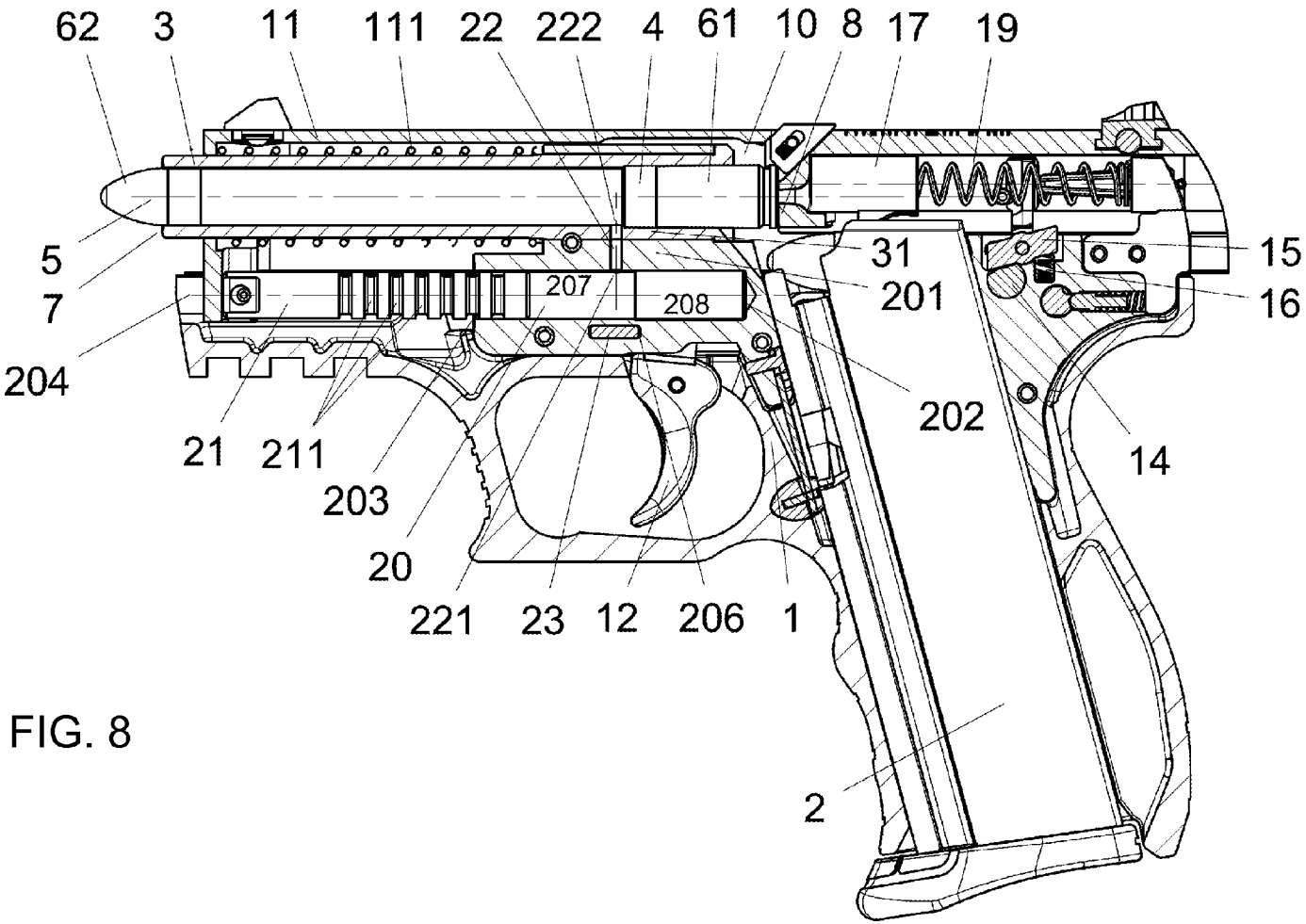
FIG. 8 a schematic flow diagram of a shot being fired—in this case: the bullet has almost left the barrel, the explosive gas from the cylinder flows back into the barrel, the explosive gas in the barrel pushes the cartridge case in the direction of the impact base plate.
Figure 9:
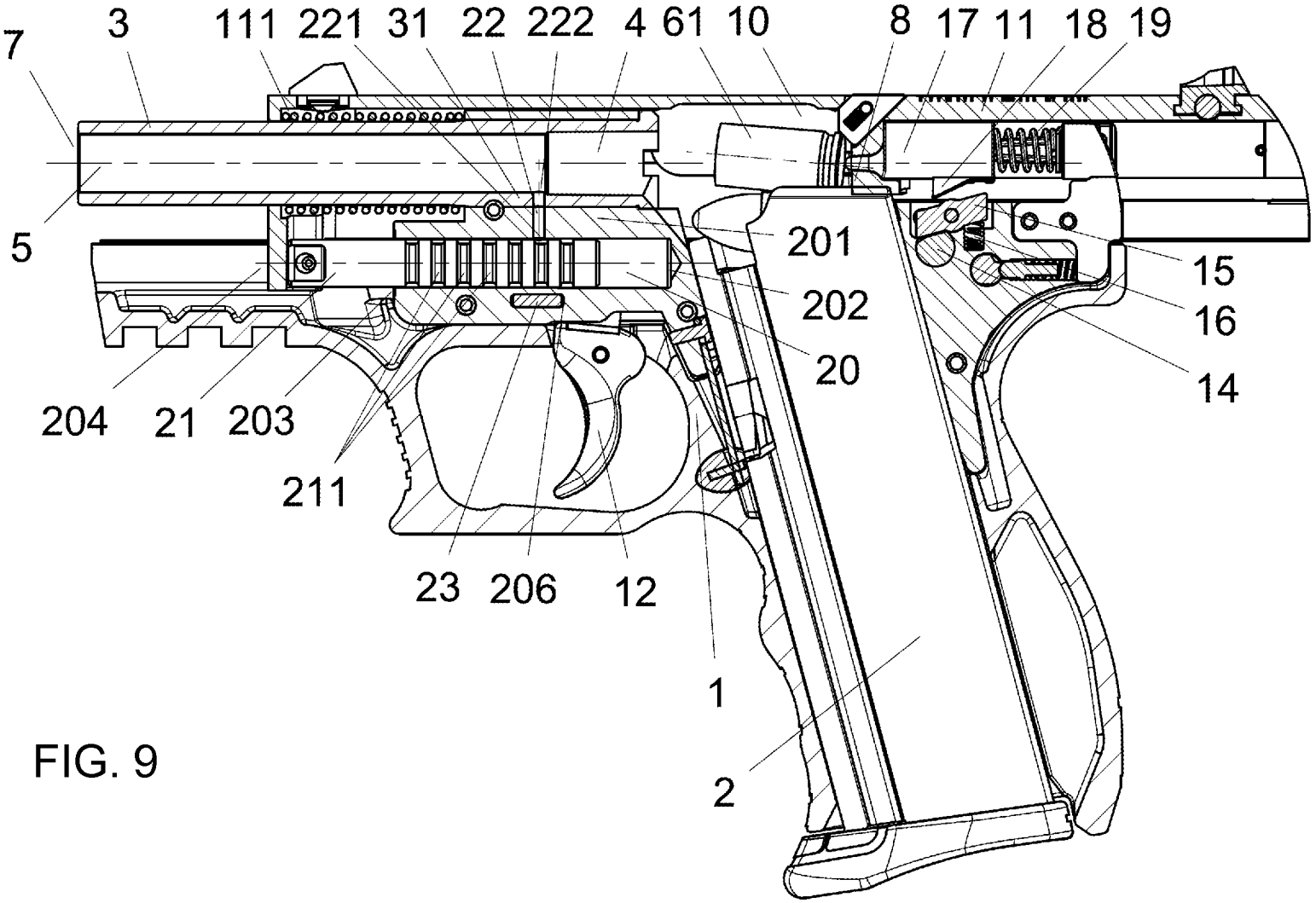
FIG. 9 shows a schematic flow diagram of a shot being fired—in this case: the slide opens and the cartridge case is ejected from the cartridge ejector.
Figure 10:
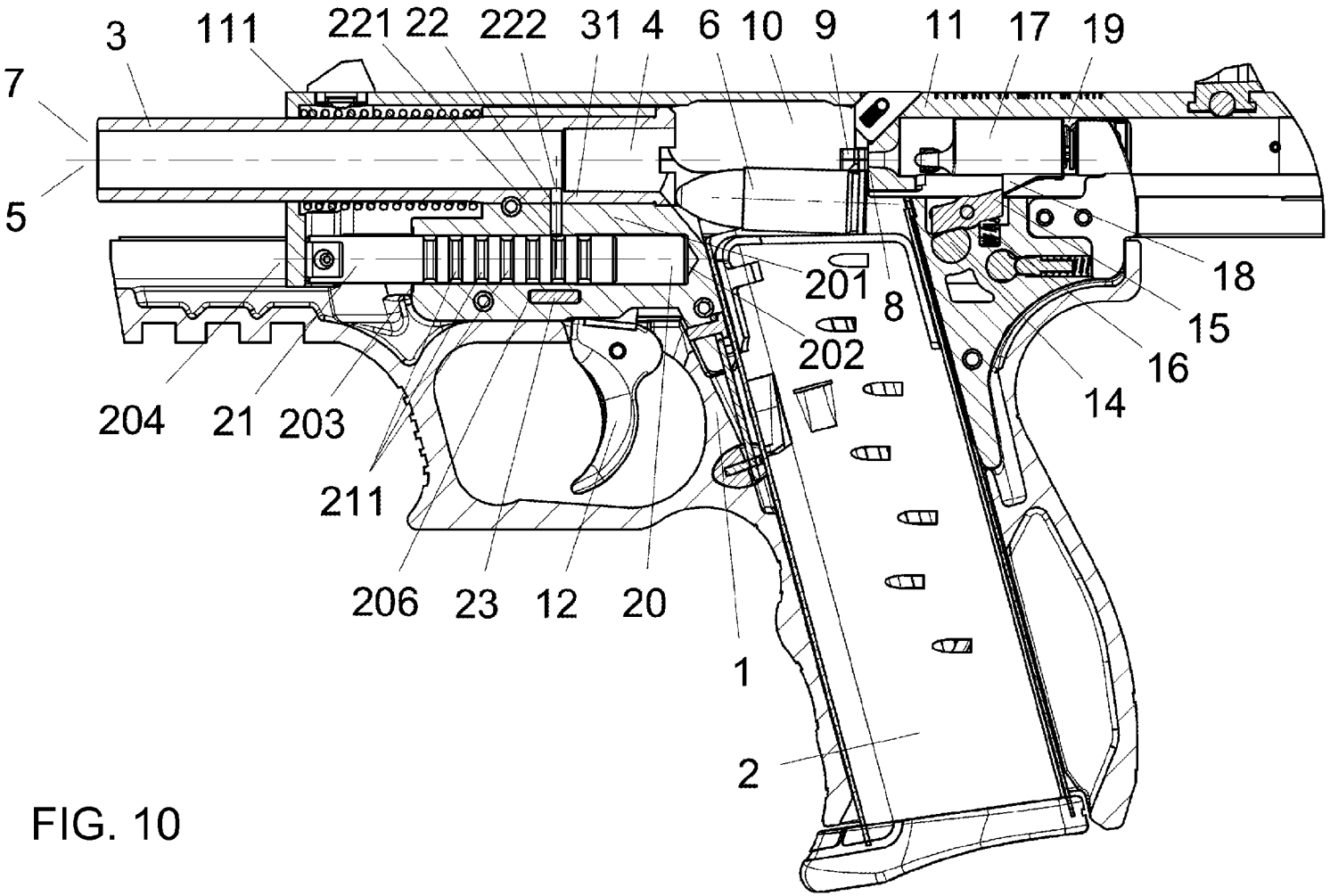
FIG. 10 shows a schematic flow diagram of a shot being fired—in this case: the slide is moved back by the slide spring in the direction of the muzzle and moves a cartridge out of the magazine into the chamber.
Figure 11:
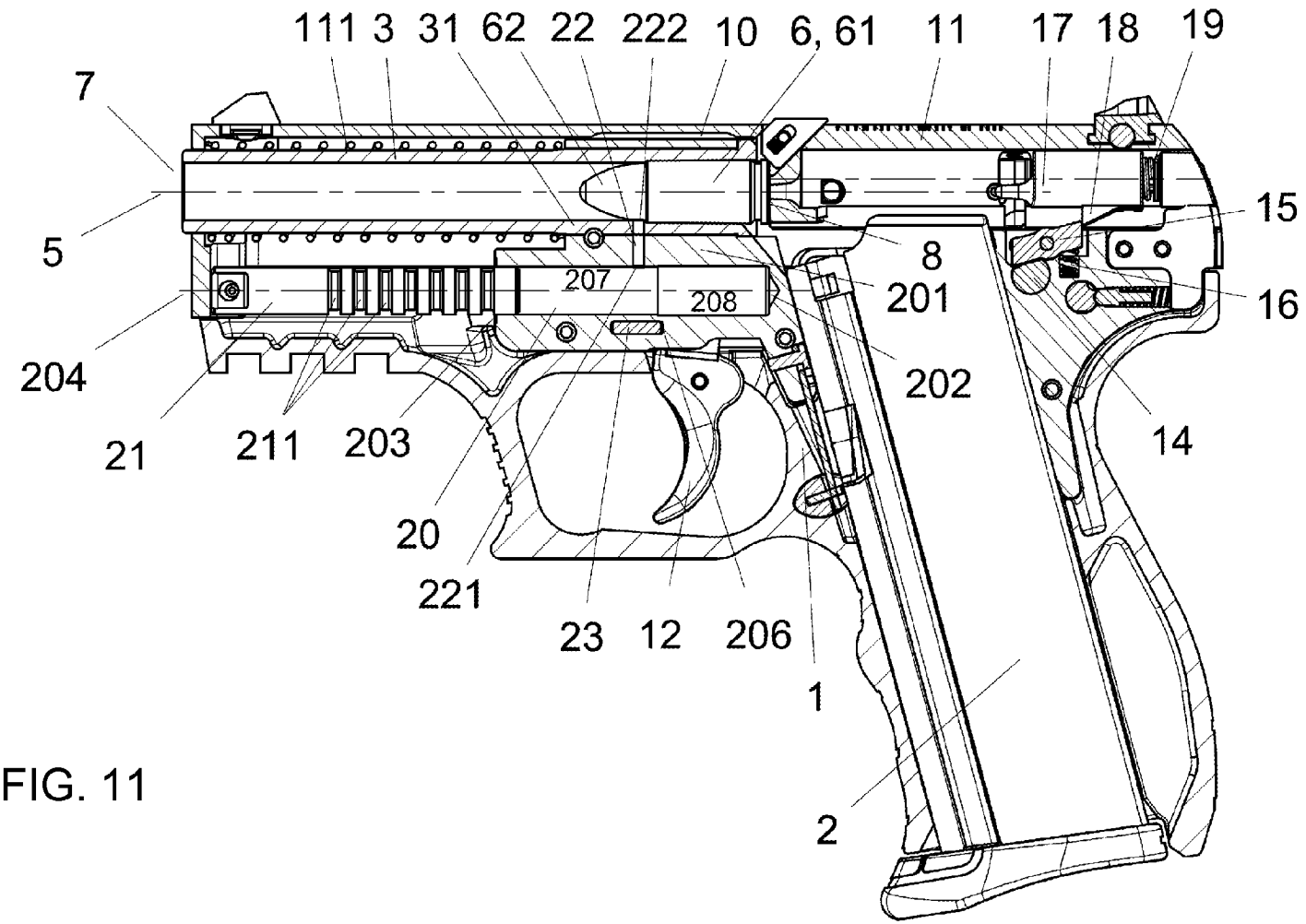
FIG. 11 shows a schematic flow diagram of a shot being fired—in this case: the firearm is ready to fire again.
Figure 12:
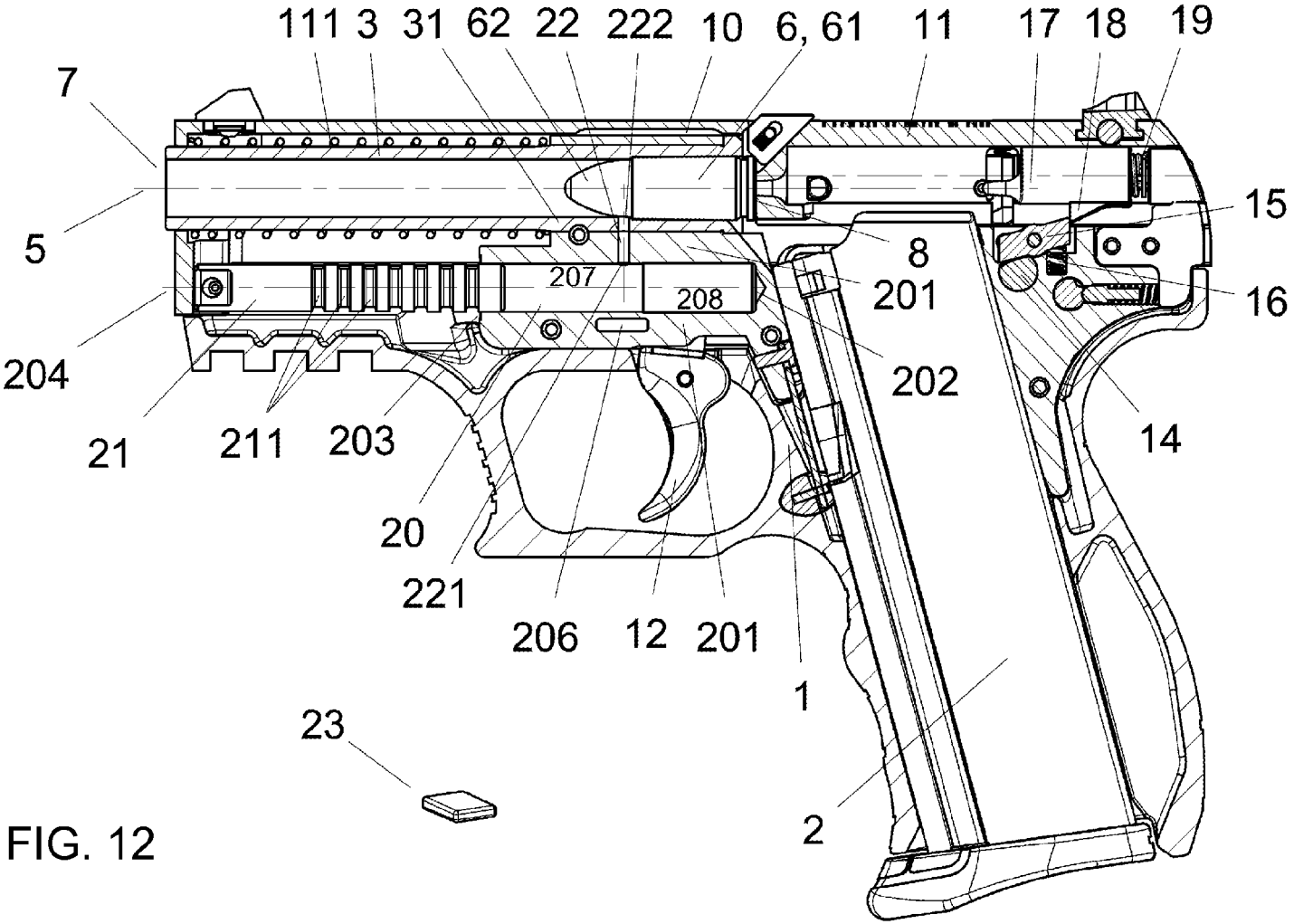
FIG. 12 shows a side sectional view of a firearm according to the invention with a separate reinforcing element or empty recess.

In an alternative embodiment of the firearm according to the invention advantageous in production terms, it may be provided that on the opposite side of the first channel opening 221 a bore 205 is arranged in the hollow cylinder wall 201, wherein the bore exhibits a first portion 205*a* and a second portion 205*b* which is divided by the recess 206. An embodiment of the firearm according to the invention of this kind is depicted in FIGS. 2*a* and 5.

The bore 205 is provided to introduce the channel 22 by means of a drill into the hollow cylinder wall 201 or else the basic body 1 and the barrel 3 or else the barrel wall 31 thereof. It is advantageous from a production point of view for the barrel mechanism and the basic body 1 to be connected before the channel 22 is introduced. The channel 22 can then be introduced such that drilling initially takes place from the opposite side of the channel 22 being introduced into the basic body 1 or the hollow cylinder wall 201. At the position in which the bore 205 is to be inserted, the recess 206 is already made in the basic body 1, preferably in the hollow cylinder wall 201 just below the surface of the wall. A first portion 205*a* of the bore can then be introduced until the recess 206 is reached. Drilling then continues and the second portion 205*b* of the bore is introduced until the drill penetrates the hollow cylinder 20. With the help of the same drill or also another thinner drill, for example, the channel 22 can then be drilled through the basic body 1 or else the hollow cylinder wall 201 and the barrel mechanism already connected to the basic body 1. The reinforcing element 23, in particular the hard metal insert, is then driven into the recess 206. In the inserted state, the reinforcing element 23 is lodged between the first bore portion 205*a* and the second bore portion 205*b* and thereby closes the bore 205 to some extent in a gas-tight manner, such that no explosive gas is able to escape through the bore 205. The region on which the explosive gases emerging from the first channel opening 221 meet is, however, similarly reinforced.

Alternatively, the firearm may also be designed without a bore 205, as is depicted by way of example in the other figures.

The invention claimed is:

1. A firearm, comprising:

a barrel mechanism with a barrel and a chamber;

a closing mechanism with a slide and a cylinder piston mechanism for gas pressure operated closure delay, said cylinder piston mechanism including a hollow cylinder with a hollow cylinder wall;

a channel formed between said barrel mechanism and said cylinder piston mechanism; and a substantially rectangular plate inserted in said hollow cylinder wall of said hollow cylinder, said substantially rectangular plate forming a reinforcing element.

2. The firearm according to claim 1, wherein said barrel has a barrel wall.

3. The firearm according to claim 2, wherein said channel includes a first channel opening formed in said hollow cylinder wall and a second channel opening formed in said barrel wall.

4. The firearm according to claim 1, wherein said reinforcing element is disposed in a recess formed in said hollow cylinder wall.

5. The firearm according to claim 1, wherein said reinforcing element is housed below a surface of said hollow cylinder wall.

6. The firearm according to claim 5, wherein said reinforcing element is disposed between 0.5 and 1 mm below the surface of said hollow cylinder wall.

7. The firearm according to claim 1, wherein said reinforcing element is made of sintered carbide or of ceramic.

8. The firearm according to claim 1, wherein said channel includes a channel opening formed in said hollow cylinder wall and said reinforcing element is disposed in said hollow cylinder opposite from said channel opening.

9. The firearm according to claim 1, wherein said channel includes a channel opening formed in said hollow cylinder wall and said hollow cylinder wall is formed with a bore opposite said channel opening, said bore having a first portion and a second portion, a recess formed between said first portion and said second portion, and said reinforcing element being housed in said recess.

10. The firearm according to claim 1, wherein said hollow cylinder comprises at least a first portion and a second portion along a longitudinal direction thereof, said first portion having a smaller diameter than said second portion, and a piston of said cylinder piston mechanism being formed with at least one circumferential groove.

11. The firearm according to claim 1 configured as a handgun.

12. A method of producing a firearm, the method comprising the following steps:

providing a firearm according to claim 1 with a recess, a hollow cylinder, and a barrel mechanism with a chamber;

introducing a first portion of a bore into the firearm up to the recess;

introducing a second portion of the bore up to the hollow cylinder;

drilling a channel to connect the hollow cylinder with the chamber of a barrel mechanism and thereby guiding a boring drill through the bore; and introducing a reinforcing element into the recess to thereby close the bore in a gas tight manner.

13. The method according to claim 12, which comprises forming the first portion of the bore into the hollow cylinder wall.

14. The method according to claim 12, wherein the reinforcing element is a substantially rectangular plate.

15. A firearm, comprising:

a barrel mechanism with a barrel and a chamber;

a closing mechanism with a slide and a cylinder piston mechanism for gas pressure operated closure delay, said cylinder piston mechanism including a hollow cylinder with a hollow cylinder wall;

a channel formed between said barrel mechanism and said cylinder-piston mechanism, said channel including a channel opening formed in said hollow cylinder wall and said hollow cylinder wall being formed with a bore opposite said channel opening, said bore having a first portion and a second portion, and a recess formed between said first portion and said second portion; and a reinforcing element disposed in said recess formed in said hollow cylinder wall between said said first portion and said second portion.

16. The firearm according to claim 15, wherein said reinforcing element is a substantially rectangular plate inserted in said recess.

* * * * *